United States Patent [19]

Ortwein

[11] Patent Number: 4,915,298

[45] Date of Patent: Apr. 10, 1990

[54] RAIL MOUNT FOR RAILWAY-TYPE RAILS

[75] Inventor: Elisabeth Ortwein, Cologne, Fed. Rep. of Germany

[73] Assignee: Hermann Ortwein, Cologne, Fed. Rep. of Germany

[21] Appl. No.: 205,428

[22] Filed: Jun. 10, 1988

[30] Foreign Application Priority Data

Jun. 10, 1987 [DE] Fed. Rep. of Germany ... 8708155[U]

[51] Int. Cl.[4] ..... E01B 9/38

[52] U.S. Cl. ..... 238/283; 238/307

[58] Field of Search ..... 238/264, 283, 287, 306, 238/307, 312, 382

[56] References Cited

U.S. PATENT DOCUMENTS

| | | | |
|---|---|---|---|
| 283,076 | 8/1883 | Chapman | 238/283 |
| 814,796 | 3/1906 | McCallum | 238/283 |
| 1,149,167 | 8/1915 | Schmidt | 238/283 |
| 3,576,293 | 4/1971 | Landis et al. | 238/283 X |
| 4,266,719 | 5/1981 | Ortwein et al. | 238/283 |
| 4,527,736 | 7/1985 | Ortwein | 238/283 |
| 4,715,533 | 12/1987 | Bucksbee et al. | 238/283 |

FOREIGN PATENT DOCUMENTS

| | | | |
|---|---|---|---|
| 2032915 | 1/1972 | Fed. Rep. of Germany | 238/283 |
| 51-605 | 4/1977 | Japan | 238/382 |

*Primary Examiner*—Andres Kashnikow
*Assistant Examiner*—Timothy Newholm
*Attorney, Agent, or Firm*—Herbert Dubno

[57] ABSTRACT

A rail mount has a metal frame in which a rigid mounting plate to which a rail is attached and received with all around clearance on a rubber plate and surrounded by a rubber strip so that the thickness of the rubber plate is $\frac{1}{8}$ to $\frac{1}{3}$ the thickness of the mounting plate, the thickness of the mounting plate is $\frac{3}{8}$ to $\frac{7}{8}$ of the height of the frame and the rubber strip has a width which is 0.5 to 0.8 times the height of the rubber strip.

6 Claims, 2 Drawing Sheets

RAIL MOUNT FOR RAILWAY-TYPE RAILS

FIELD OF THE INVENTION

My present invention relates to a rail mount upon which rails for railway systems and the like can be affixed and which are capable of supporting the rails on ties or sleepers, e.g. on concrete supports.

BACKGROUND OF THE INVENTION

The mounting of rails utilizing mounting plates and assemblies on sleepers or other supports are a well developed art as will be apparent, for example, from the following U.S. patents and the references cited therein;

U.S. Pat. No. 4,266,719; 4,577,801;

U.S. Pat. No. 4,527,736; 4,637,646;

U.S. Pat. No. 4,696,429; 4,720,043.

In one such mounting arrangement, a mounting plate upon which a rail can be affixed is provided so that it rests upon an elastomer plate within a frame.

Such systems have been generally satisfactory in practice, although experience with them has found a need for further improvement.

OBJECTS OF THE INVENTION

It is thus an object of the present invention to provide an improved rail mount of the last-mentioned type which provides advantages over earlier rail mounts utilizing a mounting plate, frame and elastomer plate or slab.

SUMMARY OF THE INVENTION

This object and others which will become apparent hereinafter are attained, in accordance with the invention in a rail mount which comprises:

a metal frame lying generally in a horizontal plane and having sides surrounding an opening;

a yieldable elastic plate or slab received in the opening and having a height less than that of the sides of the frame;

a metal mounting plate resting on the elastic plate and defining a clearance with the sides all around the mounting plate, the mounting plate at least partly extending into the opening and being provided with formations for securing a vehicle-traveling rail thereon; and a yieldable elastic strip received in the clearance and bridging between inner surfaces of the sides and an outer periphery of the mounting plate, the yieldable elastic plate having a thickness (d) which is substantially one-eighth to one-third of a thickness (D) of the mounting plate, the thickness (D) of the mounting plate being substantially two-thirds to seven-eights of a height (H) of the frame, and the strip having a substantially uniform width (B) as measured between the inner surfaces of the sides and an outer periphery of the mounting plate which is substantially 0.5 to 0.8 times the height (h) of the strip as measured between an upper edge of the frame and a lower edge of the mounting plate.

Essentially, these conditions ensure that the relatively thick mounting plate under the load of a rail vehicle traveling along the rail will not suffer any bending, but rather distribute the entire downward force on the mounting plate uniformly over the area of the elastomer plate which is coextensive in area with the underside of the mounting plate.

A further advantage of the rail mount of the invention is that its overall height can be kept small.

I have also found that the parameters of the rail mount of the invention provide a sufficiently high lateral or side guidance by the metal frame of the metal mounting plate so that in use there is little or no danger that the mounting plate willjump out of the mounting frame upon the development of forces counter to the normal downward loading forces.

With the configuration of the rail mount of the invention the horizontal stroke or displaceability in transverse and longitudinal (rail-extending) direction can be precisely limited or determined.

Because of the fact that a thick mounting plate is employed and there is a fully uniform low distribution over the entire elastomer plate which is coextensive with the underside of the mounting plate, I am able to achieve a high degree of vertical elasticity without the danger of fatigue, wear or deterioration of the material of the mounting plate as can arise when relatively thin mounting plates are employed.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
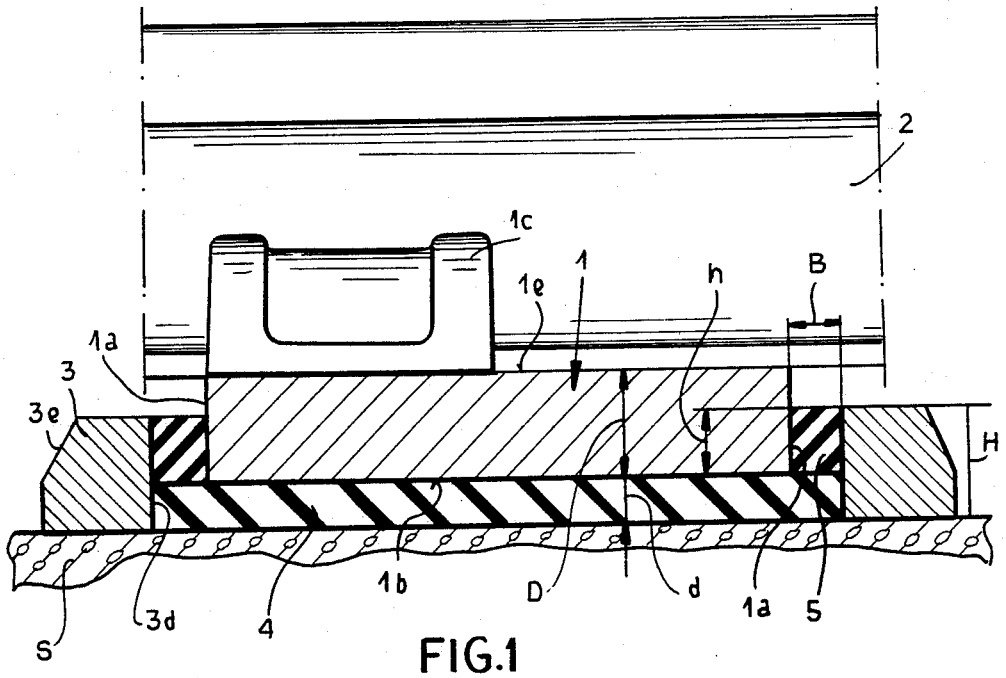
FIG. 1 is a longitudinal cross sectional view (i.e. a cross section taken in a vertical plane parallel to the rail) of a rail mount in accordance with a first embodiment of the invention.
Figure 2:
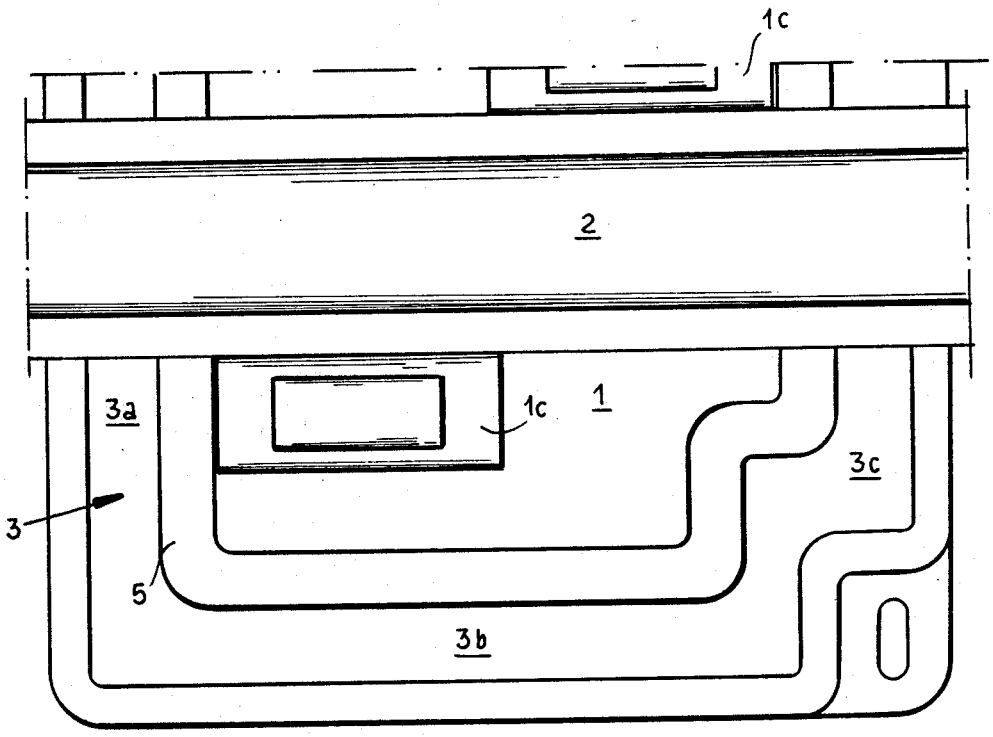
FIG. 2 is a plan view of a portion of the rail mount of FIG. 1 illustrating the parts supporting one of the rails, it being understood that a rail mount in accordance with the invention can suport one of a pair of rails or both on a single sleeper.
Figure 4:
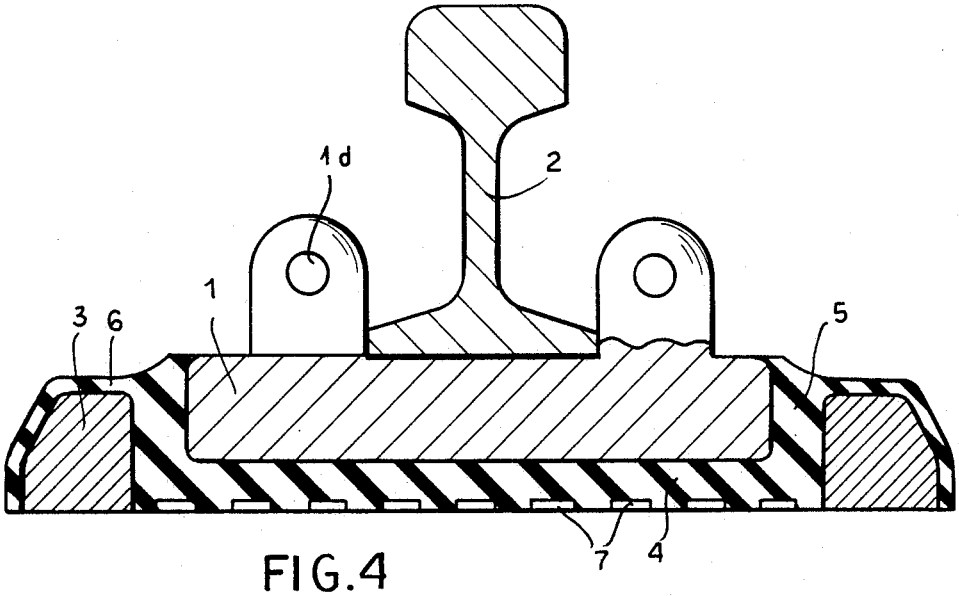
FIG. 4 is a cross sectional view taken along line IV—IV of FIG. 3 but showing the rail in place.

The rail mount seen in FIGS. 1 and 2 comprises a mounting plate 1 which has vertical sides 1*a* which form a periphery around the generally rectangular mounting plate, a planar bottom 1*b* and upstanding lugs 1*c* with throughgoing bores not visible in FIG. 1 but seen at 1*d* in FIG. 4 through which fastening elements can be inserted in a conventional manner to allow a rail 2 to be mounted on the upper surface 1*c* of the metal mounting plate 1. The metal plate 1 can thus be considered to be rigid and may be composed of cast iron or steel.

The rail mount also comprises a metal mounting frame 3 which is likewise composed of cast iron or steel and has sides 3*a*, 3*b*, 3*c*, etc., defining a closed space bounded by vertical flanks 3d and within which the mounting plate 1 is received. The frame and the mounting plate are geometrically similar so than an all around clearance is formed with a constant width B between the vertical flanks 3*d* of the frame into vertical peripheral sides 1*a* of the mounting plate 1.

A bevel 3*c* may be provided along an outer edge of the frame 3.

The mounting plate 1 rests on an elastically yieldable plate 4 which may be composed of rubber and is an elastomer, the plate 4, like the frame 3 resting upon a sleeper or tie S.

Between the mounting plate 1 and the mounting frame 3 a rubber strip 5 is received to completely fill the clearance previously mentioned. The surface or flanks of the mounting plate 1 and the frame 3 which bear against the bridging strip 5 are vertical as has been described and shown in the drawing.

However, these flanks can also be inclined to the vertical slightly if desired.

The mounting plate 1 has a thickness D and the mounting frame 3 a height H while the rubber plate 4 has a thickness d and the rubber strip 5 a width B and a height h, the latter being measured between the upper edge of the frame 3 and the lower edge of the mounting plate 1.

Figure 3:
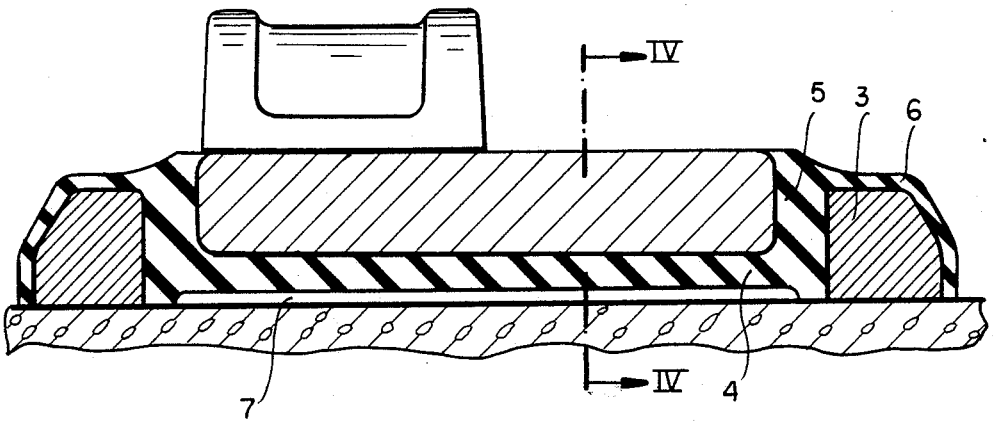
FIG. 3 is a view similar to FIG. 1 illustrating another embodiment but seen without the rail.

In the embodiment of FIGS. 3 and 4 the rubber plate 4 which is coextensive with the underside 1*b* of the mounting plate 1 is formed in one piece with the elastomer strip 5 and the elastic material can extend as a rubber layer or sheath 6 at least partly over the exposed surfaces of the frame. Longitudinal grooves 7 can form recesses along the underside of the rubber plate 4.

Instead of a rubber plate 4 and/or a rubber strip 5 a plate 5 or a strip 5 of elastomeric synthetic resin can also be used.

What is important to the present invention is that the thickness d be $\frac{1}{8}$ to $\frac{1}{3}$ of the thickness D of the mounting plate 1 and preferably between $\frac{1}{4}$ and 1/5 of the thickness D. The thickness D of the mounting plate 1 should be between $\frac{2}{3}$ and $\frac{7}{8}$ of the height H of the frame 3 and preferably about $\frac{3}{4}$ of the height H.

The width B should be between 0.5 times and 0.8 times the height h of the rubber strip and preferably between 0.6 and 0.7 times the height h.

Best results are obtained when the thickness d of the rubber plate 4 is about $\frac{1}{4}$ of the thickness D of the mounting plate 1 and the thickness D of the mounting plate is about $\frac{3}{4}$ of the height H of the mounting frame. In the best mode embodiment, the width B is about $\frac{2}{3}$ of the height H of the rubber strip 5.

I claim:

1. A rail mounting, comprising: a continuous metal frame lying generally in a horizontal plane and having vertical sides of uniform height completely surrounding an opening;

a yieldable elastic plate received in said opening, spanning said sides and having a height less than that of said sides;

a metal mounting plate resting on said elastic plate and having vertical flanks defining a clearance with said sides all around said mounting plate, said mounting plate partly extending into said opening projecting above said opening, said mounting plate being provided with formations for securing a vehicle-traveling rail thereon; and a yieldable elastic strip received in said clearance, flush with an upper surface of said frame, and bridging between said sides of said frame and said flanks of said mounting plate, said yieldable elastic plate having a thickness (d) which is one-eighth to one-third of a thickness (D) of said mounting plate, the thickness (D) of said mounting plate being two-thirds to seven-eights of a height (H) of said frame, and said strip having a width (B) as measured between the inner surfaces of said sides and an outer periphery of said mounting plate which is 0.5 to 0.8 times the height (h) of said strip as measured between an upper edge of said frame and a lower edge of said mounting plate.

2. The rail mounting defined in claim 1 wherein:

the thickness (d) of the yieldable elastic plate is about one-quarter of the thickness (D) of the mounting plate, and the thickness (D) of the mounting plate is about three-quarters of the height (H) of said frame.

3. The rail mounting defined in claim 2 wherein:

the width (B) of the strip is about two-thirds of the height (h) of the strip.

4. The rail mounting defined in claim 1 wherein said strip and said yieldable elastic plate are formed from an elastomer.

5. The rail mounting defined in claim 4 wherein said elastomer is a rubber.

6. The rail mounting defined in claim 4 wherein said elastomer is a synthetic resin.

* * * * *